US011747041B2

(12) United States Patent
Chothave et al.

(10) Patent No.: US 11,747,041 B2
(45) Date of Patent: Sep. 5, 2023

(54) HVAC FAN HOUSING SYSTEMS AND METHODS

(71) Applicant: Johnson Controls Technology Company, Auburn Hills, MI (US)

(72) Inventors: Amit R. Chothave, Nashik (IN); Karan Garg, Pune (IN); Sriram Ramanujam, Pune (IN); Dnyaneshwar G. Rokade, Pune (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 1220 days.

(21) Appl. No.: 16/267,074

(22) Filed: Feb. 4, 2019

(65) Prior Publication Data

US 2020/0248928 A1 Aug. 6, 2020

Related U.S. Application Data

(60) Provisional application No. 62/799,611, filed on Jan. 31, 2019.

(51) Int. Cl.

| | |
|---|---|
| ***F24F 13/24*** | (2006.01) |
| ***F24F 7/06*** | (2006.01) |
| ***F24F 13/20*** | (2006.01) |
| ***F04D 29/52*** | (2006.01) |
| ***F04D 29/66*** | (2006.01) |
| ***F04D 29/54*** | (2006.01) |
| ***F04D 29/60*** | (2006.01) |
| ***F04D 25/08*** | (2006.01) |

(52) U.S. Cl.

CPC ..... *F24F 13/24* (2013.01); *F04D 29/526* (2013.01); *F04D 29/541* (2013.01); *F04D 29/601* (2013.01); *F04D 29/664* (2013.01); *F24F 7/06* (2013.01); *F24F 13/20* (2013.01); *F04D 25/08* (2013.01); *F24F 2013/205* (2013.01); *F24F 2013/242* (2013.01)

(58) Field of Classification Search

CPC .... F04D 29/526; F04D 29/541; F04D 29/601; F04D 29/644; F04D 29/664

See application file for complete search history.

(56) References Cited

U.S. PATENT DOCUMENTS

| | | | | |
|---|---|---|---|---|
| 4,692,091 | A * | 9/1987 | Ritenour | F04D 29/661 415/209.1 |
| 4,945,982 | A * | 8/1990 | Das | F24F 1/06 165/125 |
| 5,215,433 | A * | 6/1993 | Weiland | F04D 29/685 415/914 |
| 5,728,979 | A | 3/1998 | Yazici et al. | |
| 5,979,595 | A | 11/1999 | Harris | |
| 7,357,621 | B2 | 4/2008 | Hustvedt et al. | |
| 7,922,442 | B2 | 4/2011 | Hopkins | |
| 8,210,308 | B2 | 7/2012 | Penner et al. | |
| 8,336,672 | B2 | 12/2012 | Derks et al. | |

(Continued)

*Primary Examiner* — Christopher Verdier

(74) *Attorney, Agent, or Firm* — Fletcher Yoder P.C.

(57) ABSTRACT

A fan shroud for a heating, ventilation, and/or air conditioning (HVAC) unit may include an outer wall to couple to a housing of the HVAC unit and an inner wall disposed within the outer wall. Additionally, the inner wall may be air permeable. The fan shroud may also include an acoustic damping material disposed between the outer wall and the inner wall. The fan shroud may encircle a fan of the HVAC unit to reduce noise.

25 Claims, 10 Drawing Sheets

(56) References Cited

U.S. PATENT DOCUMENTS

| | | | | |
|---|---|---|---|---|
| 8,770,340 | B2 | 7/2014 | Cursetjee | |
| 8,961,109 | B2 | 2/2015 | Bertels | |
| 9,010,053 | B1 | 4/2015 | Kupferberg et al. | |
| 9,574,791 | B2 | 2/2017 | Lind et al. | |
| 10,774,845 | B2 * | 9/2020 | Mercer | G10K 11/161 |
| 2009/0220334 | A1 * | 9/2009 | Vouche | F04D 29/664 415/119 |
| 2014/0299404 | A1 | 10/2014 | Lind et al. | |

* cited by examiner

HVAC FAN HOUSING SYSTEMS AND METHODS

CROSS-REFERENCE TO RELATED APPLICATIONS

This application claims priority from and the benefit of U.S. Provisional Application No. 62/799,611, filed Jan. 31, 2019, entitled "HVAC FAN HOUSING SYSTEMS AND METHODS," which is incorporated herein by reference in its entirety.

BACKGROUND

The present disclosure generally relates to heating, ventilation, and/or air conditioning (HVAC) systems and, more particularly, to a housing/shroud of a fan incorporated within an HVAC system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An HVAC system generally includes one or more fans to facilitate a flow of air through the HVAC system and/or through ductwork to/from conditioned spaces. Additionally, fans generally include a housing or shroud around the fan blades to direct the flow of air through the fan. However, in some instances, the flow of air through the housing and/or shroud, the beating of the air by the fan blades, and/or the motor to drive the fan may produce undesired noise.

SUMMARY

This section provides a brief summary of certain embodiments described in the present disclosure to facilitate a better understanding of the present disclosure. Accordingly, it should be understood that this section should be read in this light and not to limit the scope of the present disclosure. Indeed, the present disclosure may encompass a variety of aspects not summarized in this section.

The present disclosure relates to a fan shroud for a heating, ventilation, and/or air conditioning (HVAC) unit, which may include an outer wall to couple to a housing of the HVAC unit and an inner wall disposed within the outer wall. Additionally, the inner wall may be air permeable. The fan shroud may also include an acoustic damping material disposed between the outer wall and the inner wall. The fan shroud may encircle a fan of the HVAC unit to reduce noise.

The present disclosure also relates to an HVAC unit, which may include a housing including an orifice and a fan including a fan blade to rotate about an axis to motivate an air flow through the orifice of the housing. The HVAC unit may also include a sound damper having a wall and sound damping material affixed to the wall. The wall may be affixed to the housing, such that the wall is radially outward from the fan blade relative to the axis, and such that the sound damping material circumferentially surrounds the fan blade and is exposed to the air flow passing through the orifice.

The present disclosure also relates to an HVAC system, which may include a housing having a panel and an orifice formed in the panel. The HVAC system may also include a fan having a fan blade to rotate about an axis to motivate air through the orifice and an acoustic shroud having a first wall, a second wall, and a sound damping material disposed radially therebetween. The first wall may have a flange to be secured to a first side of the panel and the second wall may be secured to a second side of the panel opposite the first side, such that the first wall is removable from the panel without removal of the second wall from the panel.

BRIEF DESCRIPTION OF THE DRAWINGS

Various aspects of the present disclosure may be better understood upon reading the detailed description and upon reference to the drawings, in which.

DETAILED DESCRIPTION

Figure 1:
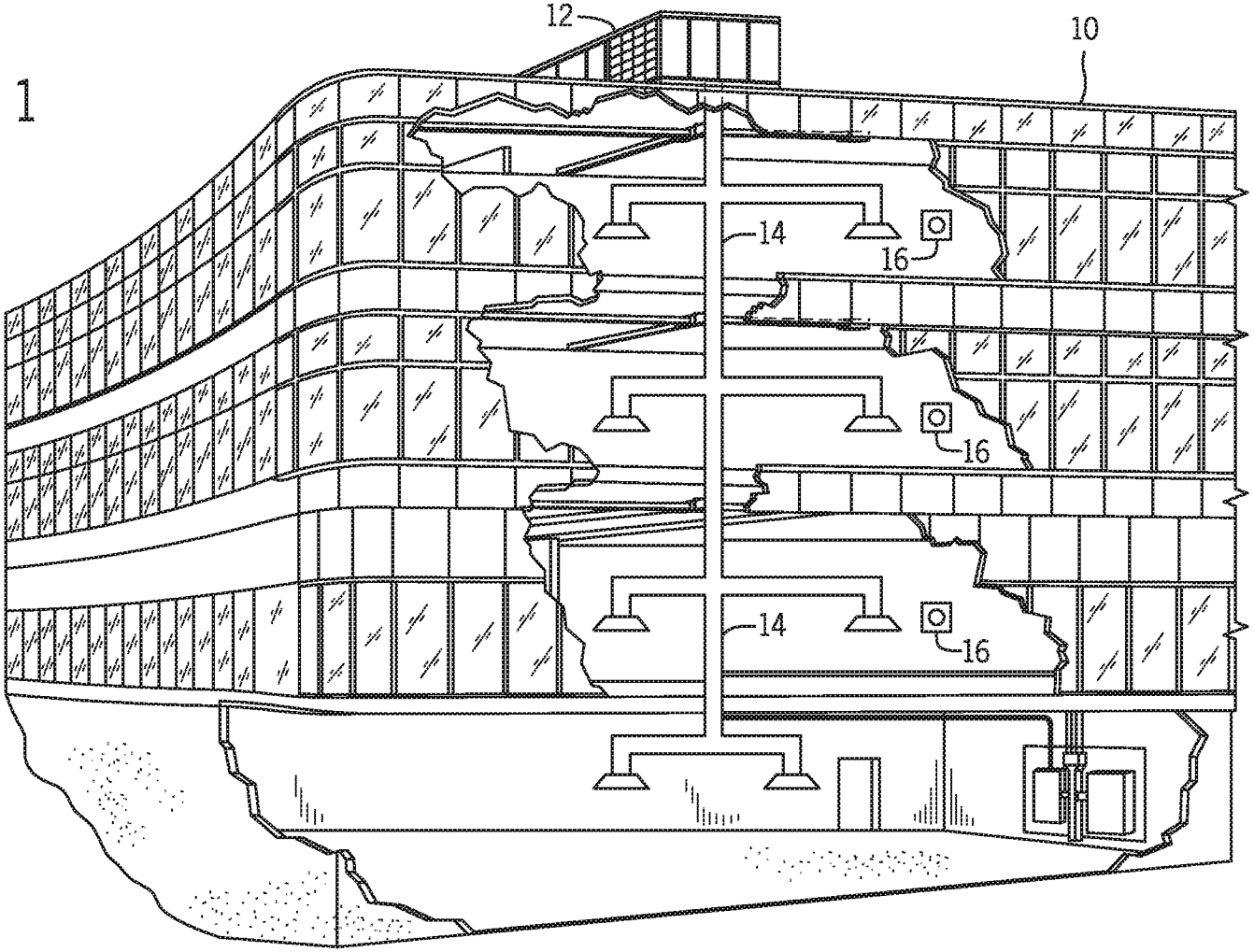
FIG. 1 is a partial cross-sectional view of an embodiment of a building that includes a heating, ventilation, and/or air conditioning (HVAC) system, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As will be discussed in further detail below, heating, ventilation, and/or air conditioning (HVAC) systems generally include one or more fans to facilitate a flow of air through the HVAC system. For example, fans may be used to move air over heat exchanger coils, such as condenser coils or evaporator coils. Additionally, fans may be used for moving air through ductwork to or from such heat exchanger coils and/or for transfer of air from one location to another. Fans may generally include a housing or shroud disposed around one or more fan blades driven by a motor to direct the flow of air to and/or from the fan blades. Such fans may be implemented as axial fans or centrifugal fans. Additionally, the flow of air through the housing and/or shroud, the beating of the air by the fan blades, and/or the motor to drive the fan may produce undesired noise. As such, embodiments of the present disclose may include a housing or shroud configured to reduce or damp the generated noises.

In one embodiment, the housing or shroud of a fan may include an acoustic material, such as a sound damping and/or attenuating material, generally disposed radially from the blades of the fan. Moreover, the housing or shroud may include an inner wall and an outer wall with the acoustic material disposed therebetween. As discussed herein, inner may refer to a placement or element radially closer to the center of the shroud than an outer placement or element. In other words, an outer placement or outer element is generally radially outward from an inner placement or inner element. Additionally, although generally described and depicted herein as applying to a shroud of an axial fan, the embodiments disclosed herein may also be applied to the housing of a centrifugal fan such as a centrifugal blower. For example, the housing of a centrifugal fan may include an inner wall and an outer wall, disposed about the fan blades or blade cage, with an acoustic material therebetween. Moreover, the embodiments disclosed herein may also be implemented on any suitable orifice within an HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
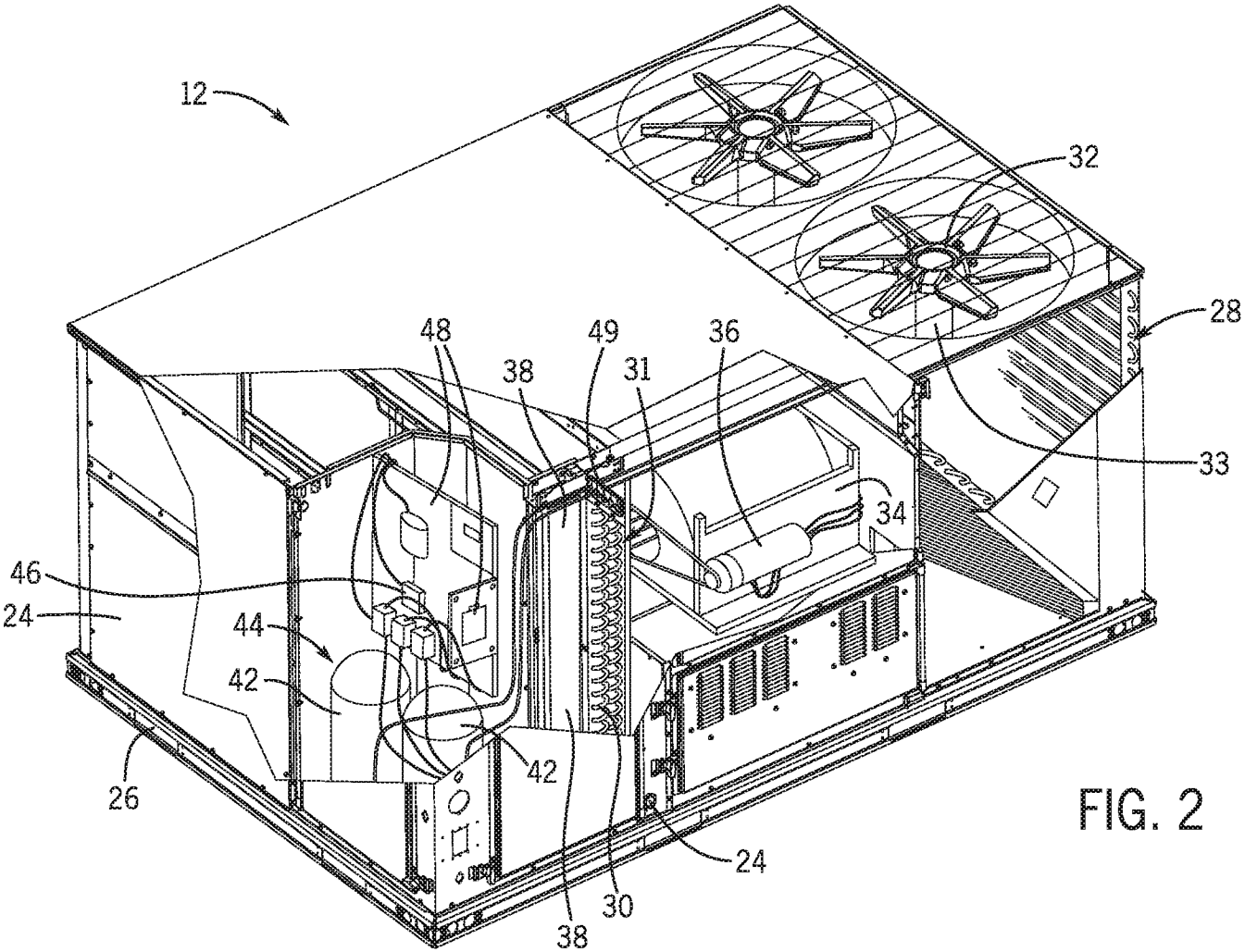
FIG. 2 is a partial cross-sectional view of an embodiment of a packaged HVAC unit, in accordance with aspects of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a housing 24 encloses the HVAC unit 12 and provides structural support and protection to the internal components from environmental and other contaminants. In some embodiments, the housing 24 may be constructed of galvanized steel and insulated with aluminum foil faced insulation. Rails 26 may be joined to the bottom perimeter of the housing 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32, driven by fan motors 33, draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
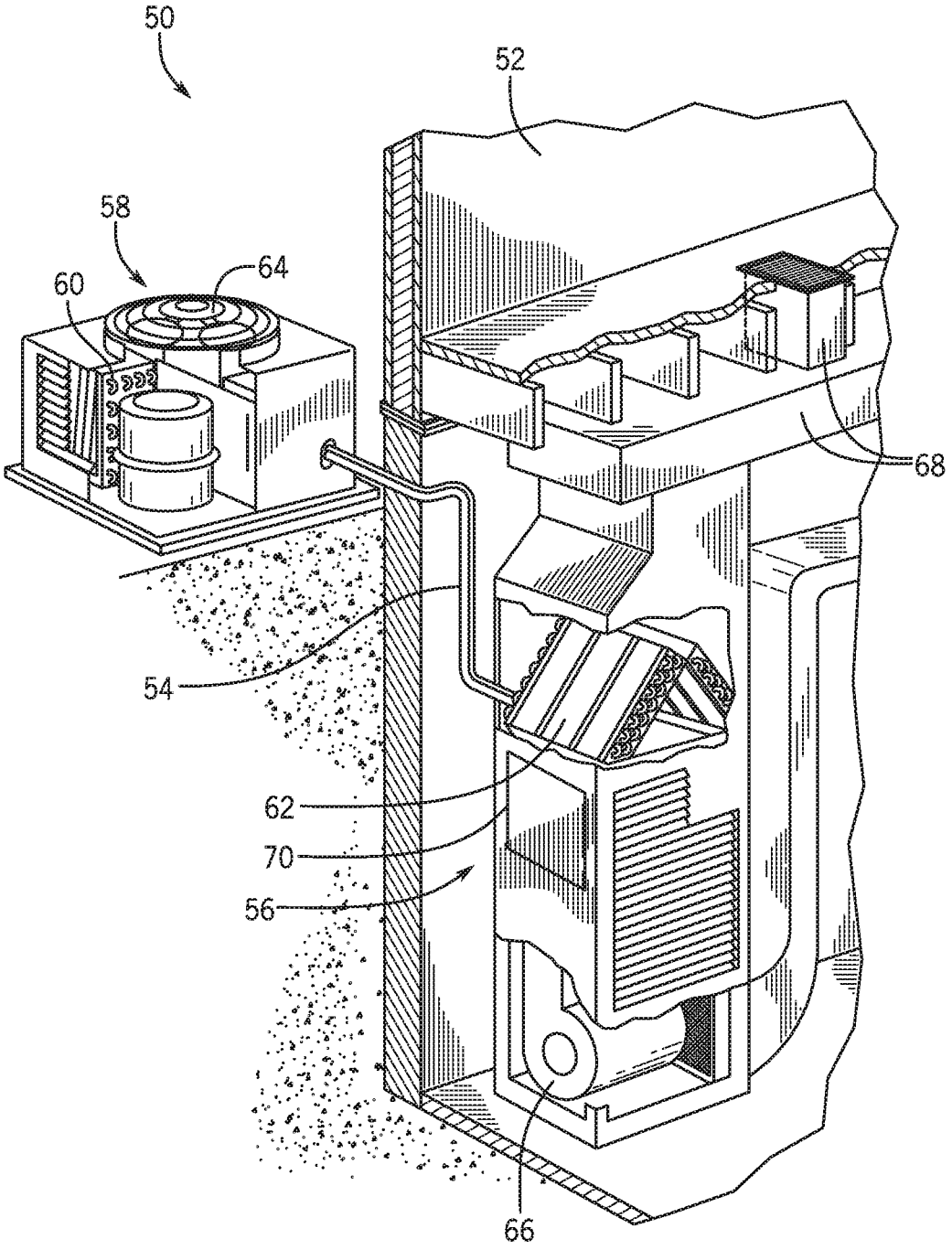
FIG. 3 is a partial cross-sectional view of an embodiment of a split, residential HVAC system, in accordance with aspects of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower or fan 66 passes over the tubes or pipes and extracts heat from the combustion products. The heated air may then be routed from the furnace system 70 to the ductwork 68 for heating the residence 52.

Figure 4:
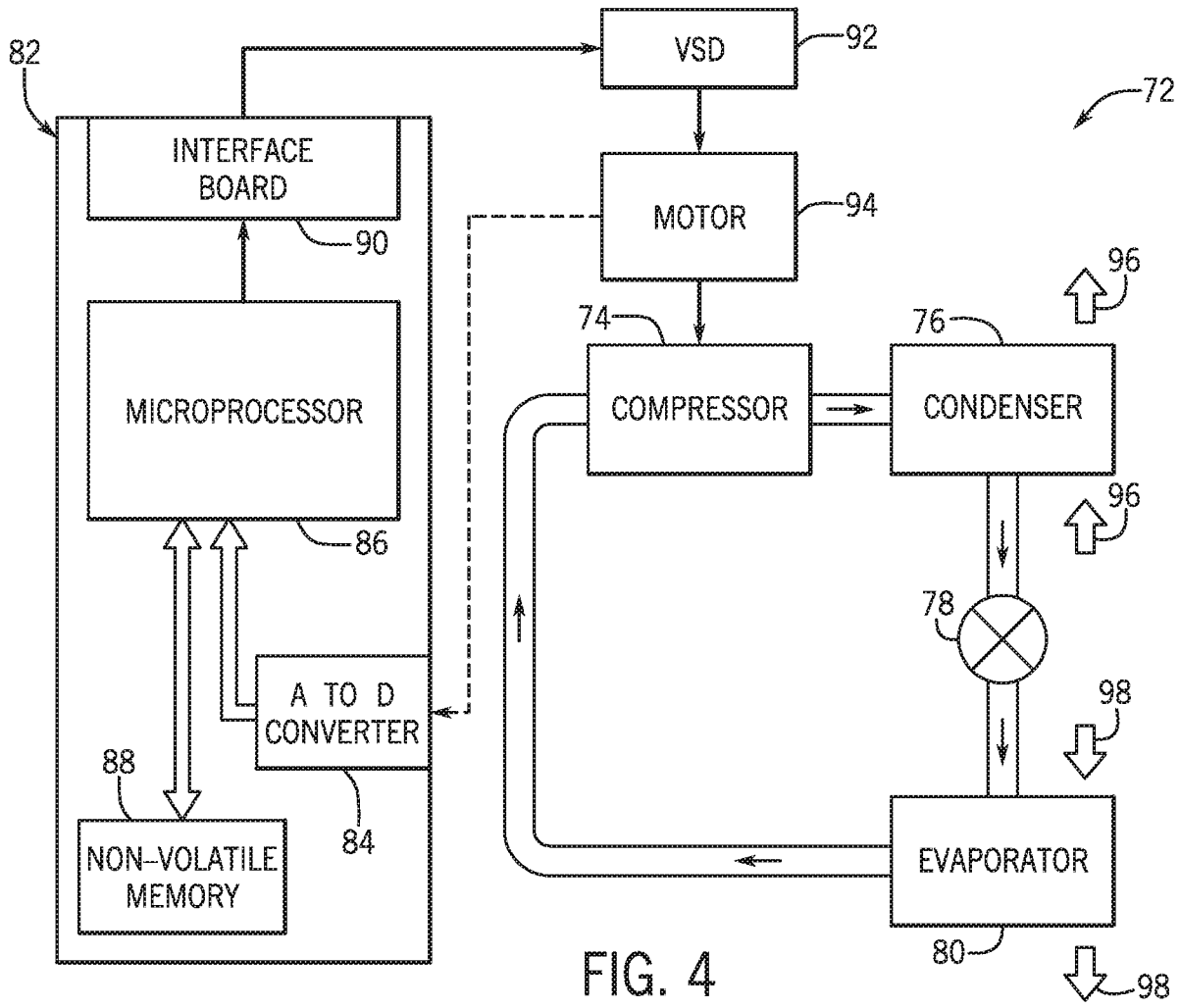
FIG. 4 is a schematic diagram of an embodiment of a vapor compression system that may be incorporated with an HVAC system, in accordance with aspects of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
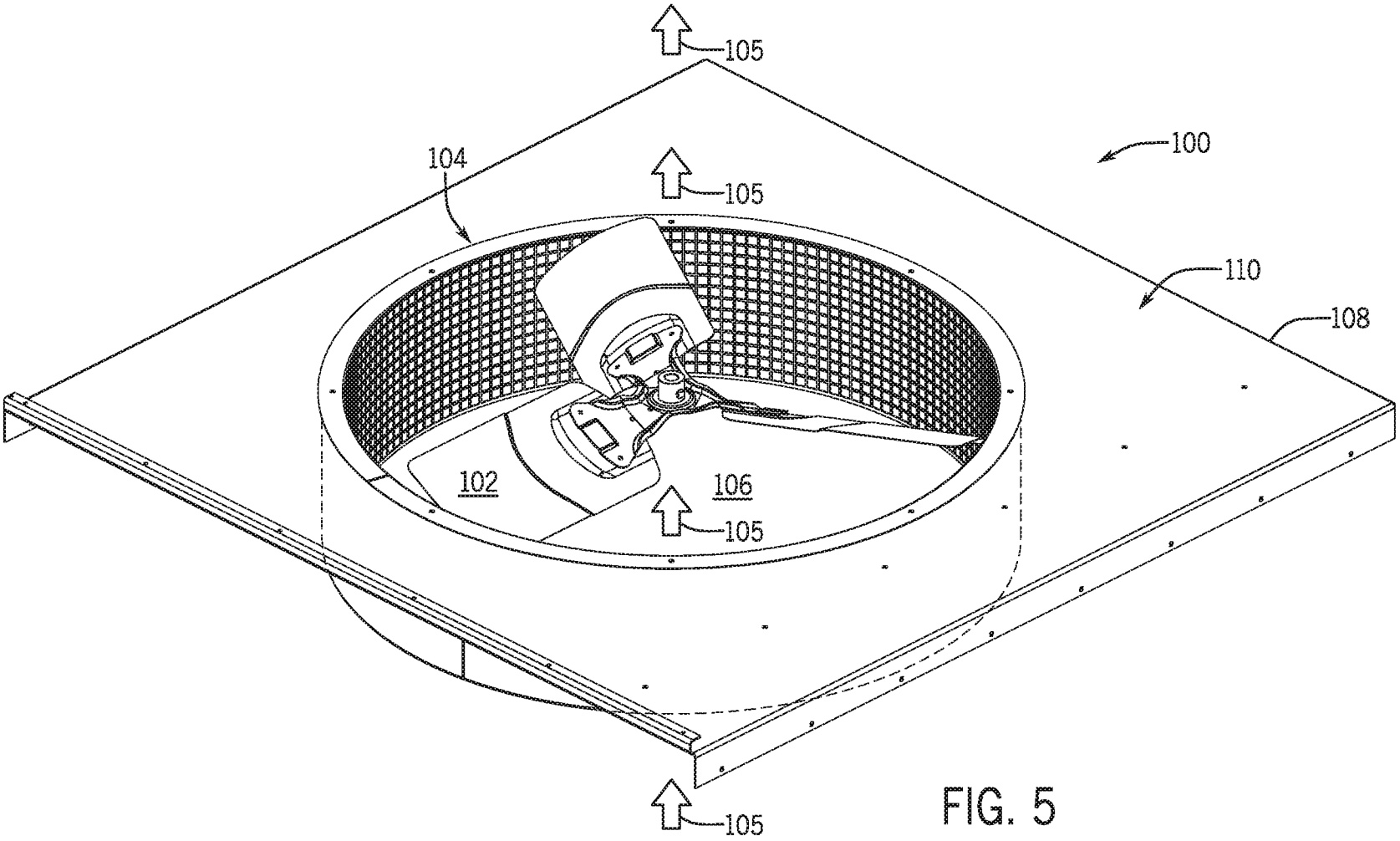
FIG. 5 is a perspective view of an embodiment of a fan shroud, in accordance with aspects of the present disclosure.

As described above, a fan of an HVAC system, such as the fan 32, 64, or 66, or blower assembly 34, may be used to facilitate the flow of air through a heat exchanger, such as the condenser 76 or evaporator 80, or through ductwork 14, 68. FIG. 5 is a perspective view of an embodiment of a fan assembly 100, including one or more fan blades 102 and an acoustic shroud 104 for facilitating an air flow 105 to the fan blades 102 through an orifice 106 of a panel 108 of HVAC system, such as the HVAC unit 12 discussed above. In particular, the fan assembly 100 is configured to reduce noise during operation. In some embodiments, the panel 108 may represent a sidewall of ductwork 14, 68, a partition within the HVAC unit 12, or a wall of the housing 24. For example, in some embodiments, the acoustic shroud 104 may be disposed around the fan 32, 64, or 66 and affixed to the panel 108 as a component a heat exchanger enclosure, such as a portion of the housing 24 around the condenser 76 or evaporator 80.

In one embodiment, the acoustic shroud 104 may be implemented around the fan 32, 64, or 66 of the HVAC unit 12, and the panel 108 may be a component of the housing 24, such that the acoustic shroud 104 extends into an inner volume of the housing 24. In contrast to a silencer, which may be generally arranged to interact with the air flow 105 after the air flow 105 has exited the housing 24 and past the fan 32, 64, or 66, the acoustic shroud 104 may reduce noise by radially surrounding the fan 32, 64, or 66 and/or the fan motor 33. Depending on implementation, in some embodiments, the acoustic shroud 104 may sit flush with an exterior surface 110 of the panel 108 or housing 24 and/or minimize the space utilized beyond the fan blades 102. As such, in some embodiments, multiple HVAC units 12 may be stacked upon one another, such as during transportation or storage, and/or take up less space while still enabling noise reduction.

Figure 6:
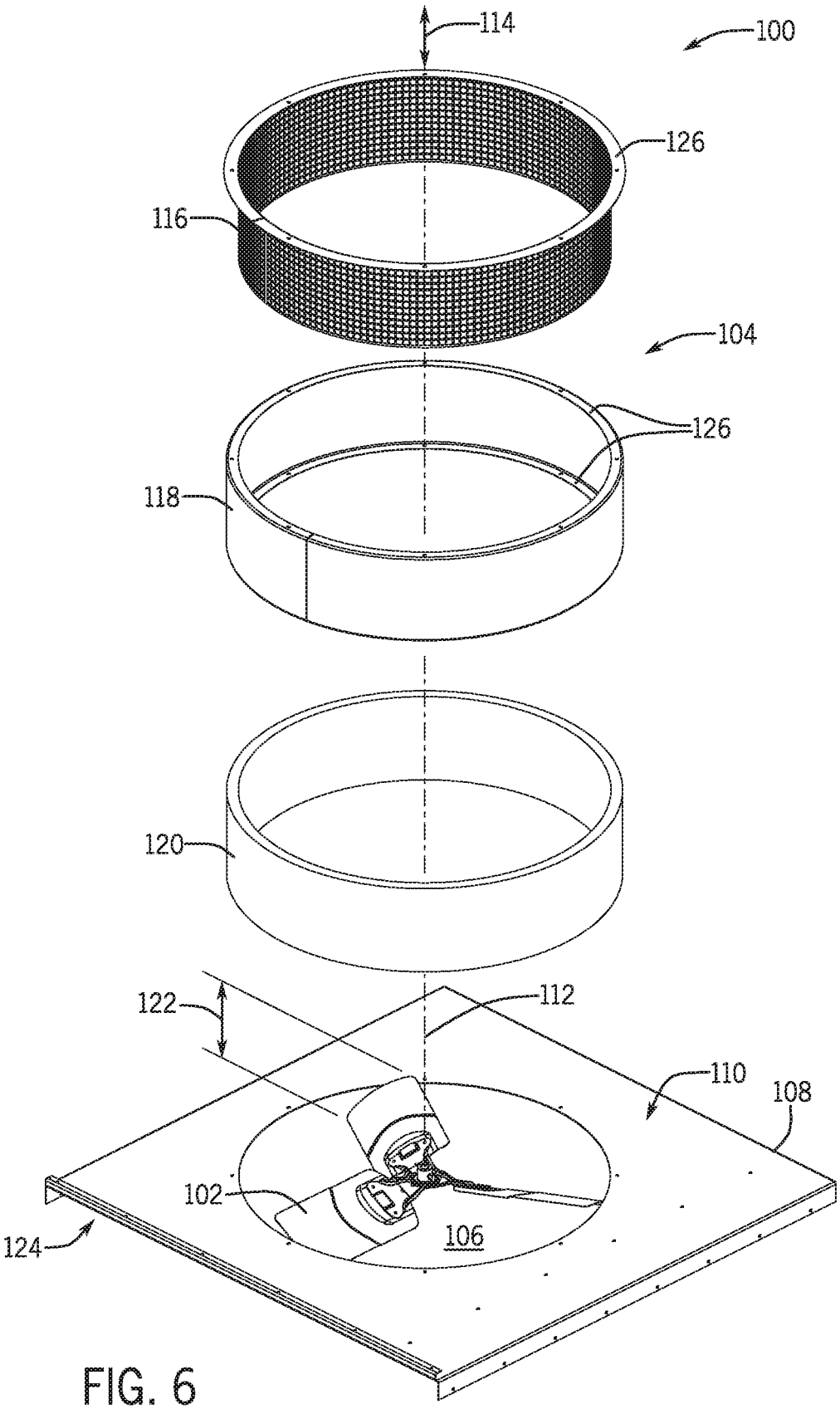
FIG. 6 is an exploded perspective view of an embodiment of the fan shroud of FIG. 5, in accordance with aspects of the present disclosure.

FIG. 6 is an exploded view of the fan assembly 100, illustrating components of the fan assembly 100 exploded along a central axis 112 in an axial direction 114. In some embodiments, the acoustic shroud 104 may include an inner wall 116, an outer wall 118, and an acoustic material 120 disposed therebetween. The inner wall 116 and/or the outer wall 118 may provide support, such as structural support and/or securement to the panel 108, to hold the acoustic material 120 in place and/or to protect the acoustic material 120 from environmental elements and/or from the air flow 105. Additionally, the inner wall 116, which is disposed radially adjacent the fan blades 102, may be perforated or otherwise porous to allow the acoustic material 120 to more effectively damp noise within and around the orifice 106. The acoustic material 120 may be of any suitable sound absorbing, sound attenuating, and/or sound damping material and, in some embodiments, may include foam. In some embodiments, the acoustic material 120 may be affixed to the inner wall 116 or to the outer wall 118, for example, via adhesives, such adhesive tape, epoxy, and so forth, via fasteners, such as screws, rivets, and so forth, and/or via other suitable mechanism of attachment.

The acoustic shroud 104 may be affixed to the panel 108 via one or more fasteners through the inner wall 116, the outer wall 118, or both. Moreover, inner wall 116, outer wall 118, or both may extend from the panel 108 into the housing 24 in the axial direction 114 by at least a portion of the axial height 122 of the fan blades 102. For example, the acoustic shroud 104 may have an axial height less than, equal to, or greater than the axial height of the fan blades 102. In some embodiments, the acoustic shroud 104 may extend axially past the fan blades 102 to radially surround the fan motor 33, either past the exterior surface 110 or past an inner surface 124 of the panel 108.

Additionally, the inner wall 116 and/or the outer wall 118 may be made of any suitable material, such as sheet metal, aluminum, tin, iron, steel, metal alloy, or polymer, such as plastic. The inner wall 116 and outer wall 118 may have one or more flanges 126 extending radially inward or outward from the general shape of the respective wall. The flanges 126 may include holes through which fasteners may affix the acoustic shroud 104 to the panel 108. Additionally or alternatively, in some embodiments, the acoustic shroud 104 may hang from the panel 108 by the flange 126 on the inner wall 116, the outer wall 118, or both. Furthermore, in some embodiments, the outer wall 118 may be affixed to the panel 108 from within the housing 24, such as on the inner surface 124 of the panel 108, and the inner wall 116 may be affixed to the panel 108 from the exterior surface 110 of the panel 108, such that the panel 108 is sandwiched between the respective flanges 126 of the inner wall 116 and the outer wall 118. Moreover, in some embodiments, the inner wall 116 and outer wall 118 may be affixed to the panel 108 via common fasteners and/or separate fasteners. As such, in some embodiments, the inner wall 116 may be removable from the panel 108 without disturbing placement of the outer wall 118.

In some scenarios, it may be desirable to replace the acoustic material 120 with another of the same or different material, for example, if the acoustic material 120 becomes damaged or worn. As such, easy and convenient access to the acoustic material 120 may increase replacement efficiency and/or reduce overhead costs associated with maintenance of the fan assembly 100. As discussed above, in some embodiments, the inner wall 116 is accessible from the exterior surface 110 of the panel 108 and may be removed without removal of the outer wall 118 from the panel 108. As such, the inner wall 116 may be removed to enable access to the acoustic material 120, such as for replacement, from outside the housing 24. As such, service time and complexity of the acoustic shroud 104 may be reduced.

Figure 7:
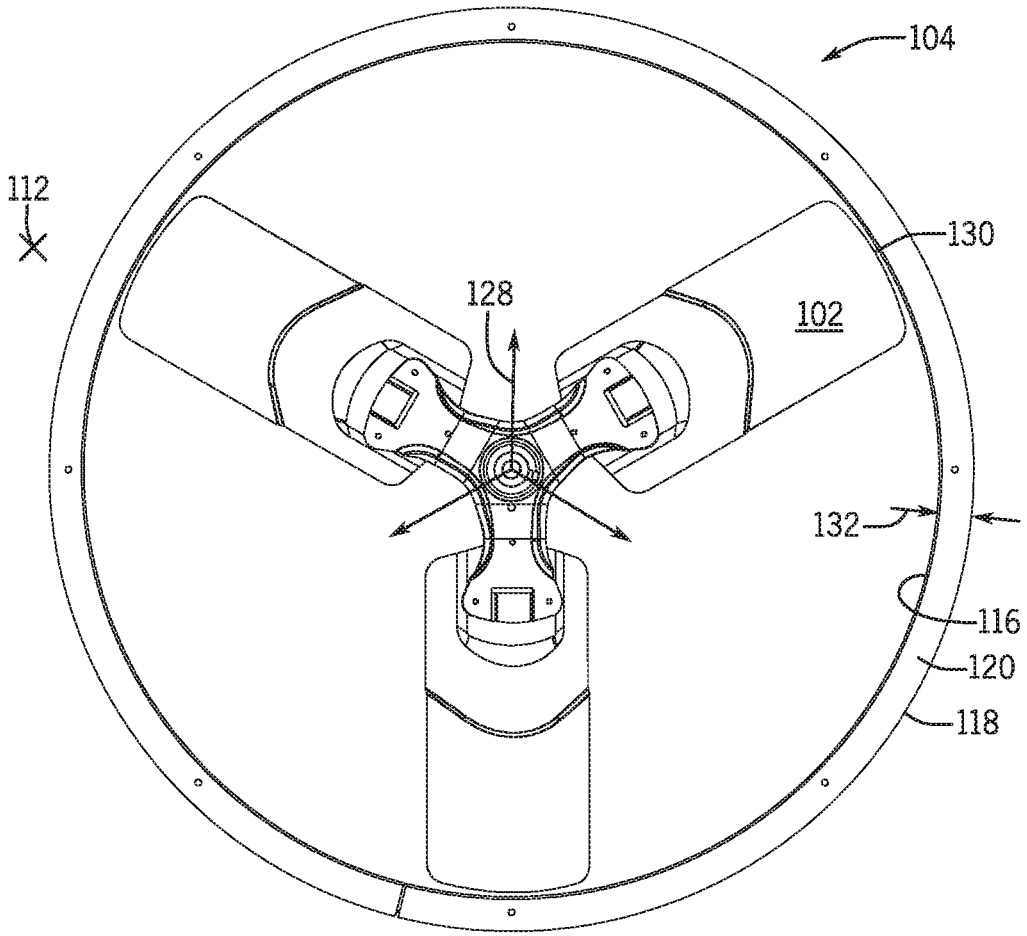
FIG. 7 is a top cutaway view of an embodiment of the fan shroud of FIG. 5, in accordance with aspects of the present disclosure.

FIG. 7 is an axial cutaway view of an embodiment of the acoustic shroud 104 and the fan blades 102. As illustrated, in some embodiments, the acoustic shroud 104 may be radially outward from the fan blades 102 and entirely circumferentially surround the fan blades 102 in a radial direction 128. Additionally, the acoustic shroud 104 may extend axially, in the axial direction 114 along the fan blades 102. The acoustic shroud 104 is positioned about the fan blades 102 to create an air gap 130 therebetween to avoid contact between the fan blades 102 and the acoustic shroud 104. Moreover, the outer wall 118 is radially outward from the inner wall 116, in the radial direction 128, and the acoustic material 120 is disposed radially between the inner wall 116 and the outer wall 118. Further, a radial distance 132 between the inner wall 116 and outer wall 118 is greater than or equal to a radial thickness of the acoustic material 120. Furthermore, in some embodiments, the acoustic material 120 may be compressed between the inner wall 116 and the outer wall 118. For example, the acoustic material 120 may be compressed between the inner wall 116 and the outer wall 118 in the radial direction 128. Additionally, the respective flanges 126 of the inner wall 116 and the outer wall 118 may extend from their respective walls by a dimension less than the distance 132 between the walls, by a dimension approximately equal to the distance 114 between the walls, or by a dimension greater than the distance 132 between the walls. Depending on implementation, the distance 132 between the walls 116, 118 may be greater than or equal to 0.25 inches, less than or equal to 1.0 inch, less than or equal to 4.0 inches, or less than or equal to 10.0 inches.

Figure 8A:
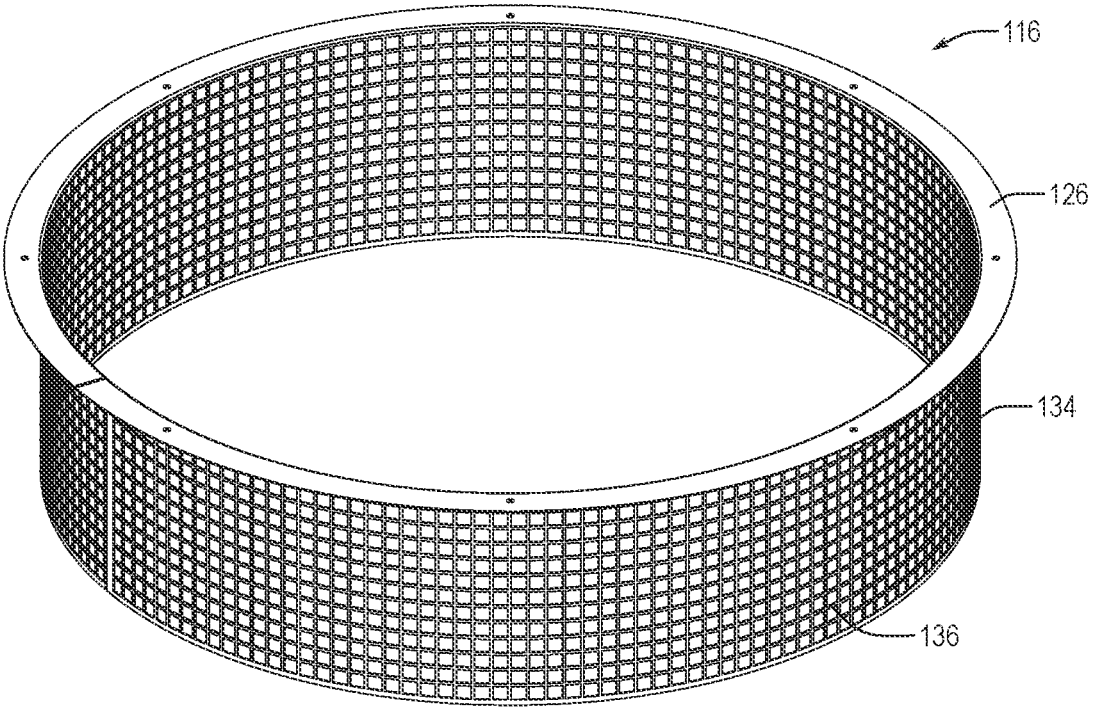
FIG. 8A is a perspective view of an embodiment of an inner section of the fan shroud of FIG. 5, in accordance with aspects of the present disclosure.
Figure 8B:
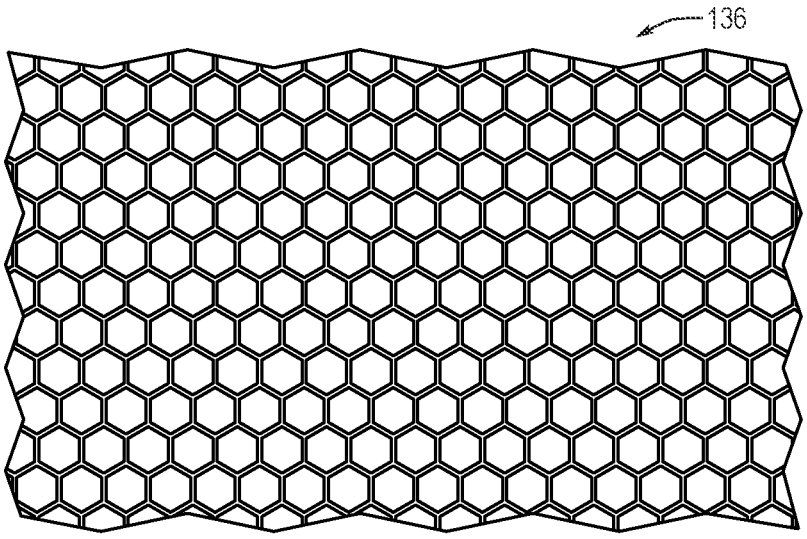
FIG. 8B is a schematic representation of an embodiment of honeycomb perforations in the inner section of FIB. 8A, in accordance with aspects of the present disclosure.

FIG. 8 Ais a perspective view of an embodiment of the inner wall 116. As discussed above, the inner wall 116 may assist in retaining and/or supporting the acoustic material 120 within the acoustic shroud 104. Additionally, the inner wall 116 may include a generally cylindrical cage 134 for radially surrounding the fan blades 102. However, as should be appreciated, the acoustic shroud 104 may take on any suitable shape configured to extend about the fan blades 102 in a circumferential direction, and the inner wall 116 may, likewise, correspond to the shape of the acoustic shroud 104. For example, the acoustic shroud 104 and inner wall 116 may have a circular, elliptical, rectangular, or polygonal cross-section relative to a plane extending in the radial direction 128. Additionally, the inner wall 116 may include one or more perforations 136 or air permeable openings to enable sound waves generated during operation of the fan blades 102 to be damped more effectively. In some embodiments, the perforations 136 may include a wire mesh, slots, and/or apertures formed in the cage 134. In some embodiments, the perforations 136 may have a honeycomb configuration, as illustrated in the schematic representation of FIG. 8B.

Figure 9:
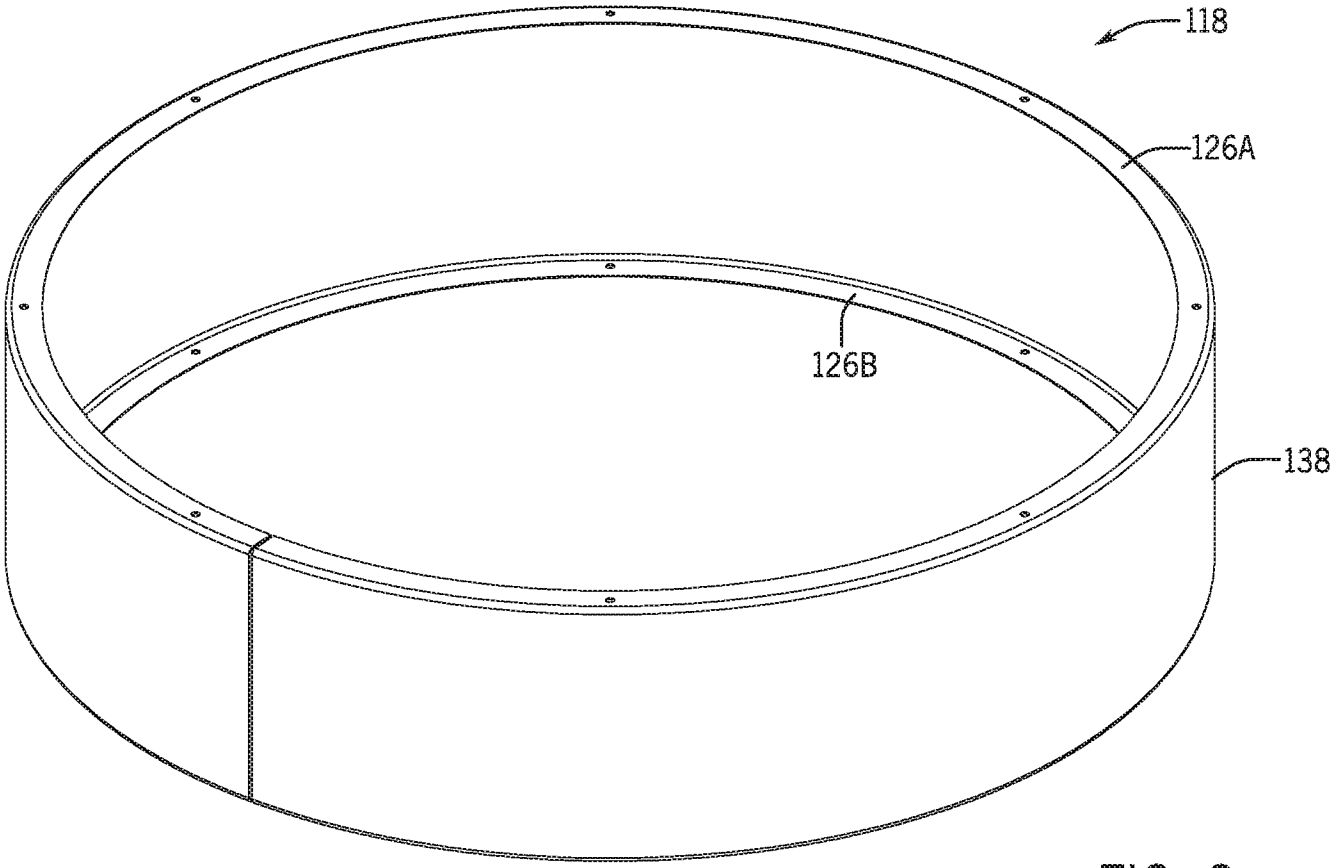
FIG. 9 is a perspective view of an embodiment of an outer section of the fan shroud of FIG. 5, in accordance with aspects of the present disclosure.

Additionally, as depicted in FIG. 9, which is a perspective view of an embodiment of the outer wall 118, the outer wall 118 may have a generally cylindrical shell 138. Similar to the cage 134 of the inner wall 116, the shell 138 of the outer wall 118 may be of any suitable shape such as, for example, having a circular, elliptical, rectangular, or polygonal cross-section. Moreover, the outer wall 118 may have the same or different cross-sectional shape as the inner wall 116. For example, the acoustic shroud 104 may include the inner wall 116 having a cylindrical shape and the outer wall 118 having a rectangular shape. In some embodiments, the outer wall 118 may have a top flange 126A, a bottom flange 126B, both, or neither. As discussed above, the flanges 126 may have holes for mounting the outer wall 118 to the panel 108. Additionally or alternatively, a bracket may be used to attach the shell 138 to the panel 108 with or without attachment via the flange 126. Moreover, the bracket may be affixed directly or indirectly to a flange 126 of the inner wall 116, for example, via fasteners. Further, in some embodiments, the acoustic material 120 may be retained within the shell 138 via the top flange 126A, the bottom flange 126B, the cage 134, or a combination thereof. Furthermore, the cage 134 may extend, at least partially, over the acoustic material 120, in the axial direction 114. For example, the cage 134 may extend from the top flange 126A halfway to the bottom flange 126B, to the bottom flange 126B, or past the bottom flange 126B.

Figure 10A:
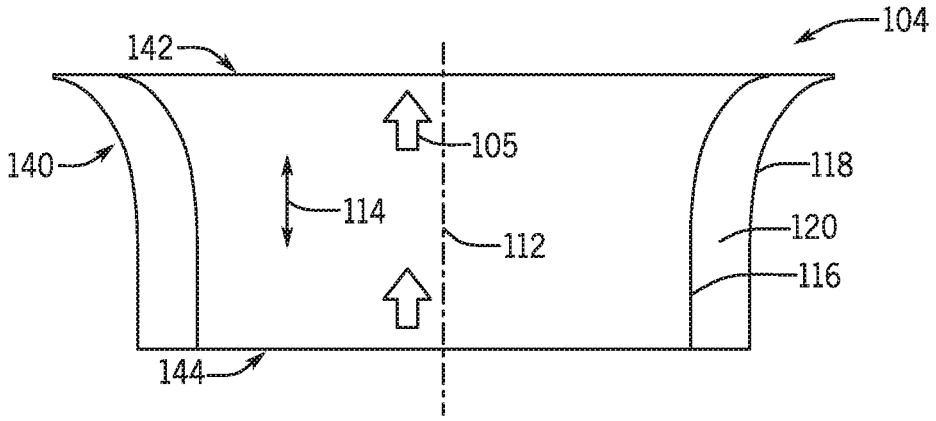
FIG. 10A is a cross-sectional side view of an embodiment of a profile shape of the fan shroud of FIG. 5, in accordance with aspects of the present disclosure.
Figure 10B:
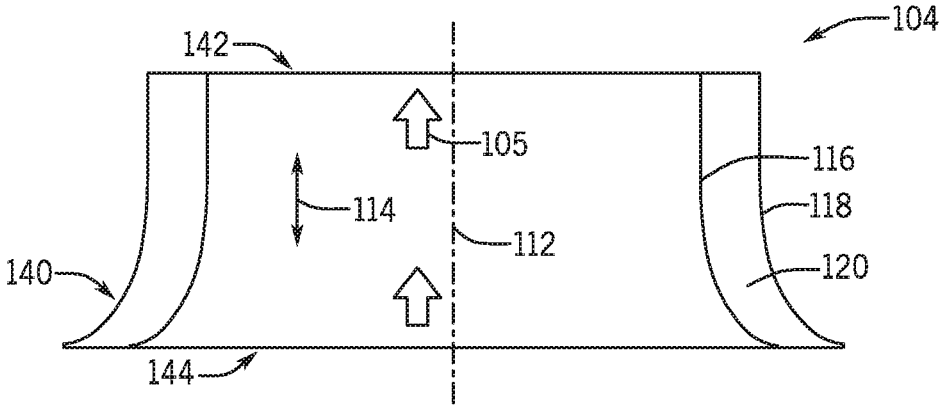
FIG. 10B is a cross-sectional side view of an embodiment of a profile shape of the fan shroud of FIG. 5, in accordance with aspects of the present disclosure.
Figure 10C:
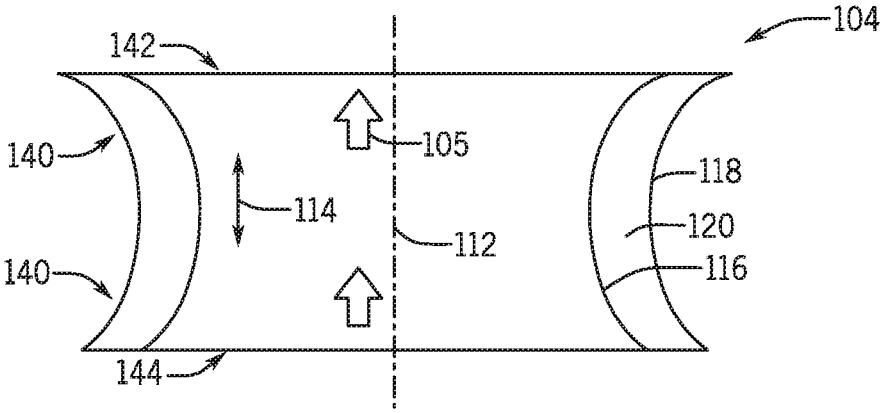
FIG. 10C is a cross-sectional side view of an embodiment of a profile shape of the fan shroud of FIG. 5, in accordance with aspects of the present disclosure.

As stated above, the inner wall 116 and outer wall 118 may be of any suitable shape for surrounding the fan blades 102. Additionally, the acoustic shroud 104 may include a generally rectangular side profile, relative to a plane extending in the axial direction 114, or any suitable side profile for facilitating the air flow 105 to and/or from the fan blades 102 and for reducing noise generated during operation of the fan assembly 100. FIGS. 10A, 10B, and 10C are side views of further example side profiles of the acoustic shroud 104. In some embodiments, the acoustic shroud 104 may include flares 140 to increase the efficiency of the air flow 105 into or from the fan blades 102. Further, the flares 140 may be disposed on the inner wall 116, outer wall 118, or both to change the diameter of the acoustic shroud 104 and/or the orifice 106 through which the air flow 105 flows. For example, the inner wall 116 may include a flare 140 while the outer wall 118 is relatively straight in the axial direction 114 or both the inner wall 116 and the outer wall 118 may include the flare 140. Furthermore, flares 140 may be implemented at the axial end 142 of the acoustic shroud 104, relative to the air flow 105, the axial beginning of the acoustic shroud, or both.

In some embodiments, the acoustic shroud 104 may be implemented without the inner wall 116 or without the outer wall 118. For example, if the acoustic material 120 is affixed to the inner wall 116, the acoustic shroud 104 may be affixed to the panel 108 via the flange 126 of the inner wall 116, and the outer wall 118 may be omitted. Moreover, if the acoustic material 120 is affixed to the outer wall 118, the acoustic shroud 104 may be affixed to the panel 108 via the flange 126 of the outer wall 118, and the inner wall 116 may be omitted.

In some embodiments, the acoustic shroud 104 or a wall thereof may be made into or formed with the panel 108 or other wall of the housing 24. Such an embodiment, may, for example, be a part of a newly installed or manufactured HVAC unit 12. Additionally or alternatively, the acoustic shroud 104 may be implemented as a retrofit to existing HVAC units 12 without changing the fan blades 102 or modifying the orifice 106, which may be formed in a panel 108 of the housing 24. For example, in some embodiments, the cage 134 of the inner wall 116 may be dimensioned to pass through the orifice 106 without inhibiting the fan blades 102 and maintaining, at least a portion of, the air gap 130. In other embodiments, an existing embodiment of the orifice 106 may be modified, such as by enlarging the diameter of the orifice 106, to enable accommodation of the acoustic shroud 104 therein. Moreover, in some embodiments, the whole acoustic shroud 104 may be implemented on a single side of the panel 108 around the fan blades 102, for example, so as to not interfere with the rotation of the fan blades 102. Furthermore, the inner wall 116, outer wall 118, the acoustic material 120, or a combination thereof may be duplicated and placed on either side of the panel 108 so as to radially surround the fan blades 102, for example, if the fan blades 102 extend axially outward on either side of the panel 108.

As discussed herein, the acoustic shroud 104 may be implemented in new or existing HVAC units 12 to reduce the noise associated with moving air through the orifice 106. Moreover, the acoustic shroud 104 may include the inner wall 116 and/or the outer wall 118 and an acoustic material 120 disposed radially around the fan blades 102 and/or the fan motor 33. As such, the acoustic shroud 104 may provide an efficient air flow 105, damp noises associated with the air flow 105, and maintain a low profile by surrounding the fan blades 102 and occupying a minimal amount of space past the exterior surface 110 of the panel 108 or outside the housing 24.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A fan shroud for a heating, ventilation, and/or air conditioning (HVAC) unit, comprising:

an outer wall configured to couple to a housing of the HVAC unit, wherein the outer wall comprises a cylindrical shell and a flange extending from the cylindrical shell and configured to mechanically fasten to a first side of a panel of the housing;

an inner wall disposed within the outer wall and configured to mechanically fasten to a second side of the panel, opposite the first side, wherein the inner wall is air permeable; and an acoustic damping material disposed between the outer wall and the inner wall, wherein the fan shroud is configured to encircle a fan of the HVAC unit.

2. The fan shroud of claim 1, wherein the acoustic damping material fully encircles the fan.

3. The fan shroud of claim 1, wherein the flange extends a distance inward from the cylindrical shell relative to a central axis of the fan shroud.

4. The fan shroud of claim 3, wherein the acoustic damping material is adjacent to the cylindrical shell and does not extend inwardly beyond the flange.

5. The fan shroud of claim 3, wherein the flange of the outer wall is configured to mechanically fasten to the housing via fasteners extending through the panel of the housing and the flange.

6. The fan shroud of claim 1, wherein the inner wall is made of perforated sheet metal, wire mesh, or both.

7. The fan shroud of claim 1, wherein the inner wall has honeycomb perforations formed therein.

8. The fan shroud of claim 1, wherein the inner wall comprises a second flange extending radially outward from the inner wall and configured to mechanically fasten the inner wall to the second side of the panel of the housing, and wherein the inner wall extends from the second flange through the panel and axially beyond an inner the first side of the panel relative to a central axis of the fan shroud.

9. The fan shroud of claim 1, wherein the acoustic damping material is adhered to the outer wall.

10. The fan shroud of claim 1, wherein the fan shroud is configured to entirely circumferentially surround a set of blades of the fan relative to a central axis of the fan shroud, and wherein the fan shroud is configured to extend over an axial length of the set of blades.

11. The fan shroud of claim 1, wherein the outer wall, the inner wall, or both are configured to be retrofitted to the HVAC unit without modification to the fan, an orifice of the housing, or both.

12. The fan shroud of claim 1, wherein the fan shroud is configured to be disposed about an orifice in the housing, such that air operatively moved by the fan passes through the fan shroud.

13. The fan shroud of claim 1, wherein the outer wall is configured to couple to the panel of the housing adjacent a condenser section of the HVAC unit, wherein the fan is a condenser fan.

14. The fan shroud of claim 1, wherein the inner wall, the outer wall, or both include a flare extending outward relative to a central axis.

15. A heating, ventilation, and/or air conditioning (HVAC) unit, comprising:

a housing including an orifice;

a fan including a fan blade configured to rotate about an axis to motivate an air flow through the orifice of the housing; and a sound damper having a first wall, a second wall disposed radially inward from the first wall relative to the axis, and sound damping material disposed radially between the first wall and the second wall relative to the axis, wherein the first wall comprises a first flange, the second wall comprises a second flange, and the first flange and the second flange are configured to enable mechanical coupling between the first wall and the second wall, wherein the first wall is affixed to the housing such that the first wall is radially outward from the fan blade relative to the axis and such that the sound damping material circumferentially surrounds the fan blade and is exposed to the air flow passing through the orifice.

16. The HVAC unit of claim 15, wherein the second wall includes perforations to enable contact between the air flow and the sound damping material.

17. The HVAC unit of claim 16, wherein the perforations have a honeycomb configuration.

18. The HVAC unit of claim 15, wherein the first wall and the second wall are formed from sheet metal.

19. The HVAC unit of claim 15, wherein the sound damping material is a foam.

20. The HVAC unit of claim 15, wherein the sound damping material is affixed to the first wall, the second wall, or both.

21. A heating, ventilation, and/or air conditioning (HVAC) system, comprising:

a housing having a panel and an orifice formed in the panel;

a fan having a fan blade configured to rotate about an axis to motivate air through the orifice; and an acoustic shroud having a first wall, a second wall, and a sound damping material disposed radially between the first wall and the second wall relative to the axis, wherein the first wall has a flange configured to be secured to a first side of the panel and the second wall is configured to be secured to a second side of the panel opposite the first side, such that the first wall is removable from the panel without removal of the second wall from the panel.

22. The HVAC system of claim 21, wherein the acoustic shroud is configured to circumferentially surround the fan blade relative to the axis and extend axially beyond the fan blade relative to the axis.

23. The HVAC system of claim 21, wherein the first wall includes perforations to enable contact between the air and the sound damping material.

24. The HVAC system of claim 21, comprising a fan motor configured to drive rotation of the fan blade, wherein the acoustic shroud is configured to axially overlap with the fan motor relative to the axis.

25. The HVAC system of claim 21, wherein the first wall and the second wall are each formed from sheet metal, and wherein the sound damping material is a foam.

* * * * *